US011459796B2

(12) United States Patent
Schmück

(10) Patent No.: US 11,459,796 B2
(45) Date of Patent: Oct. 4, 2022

(54) LATCH MODULE

(71) Applicant: Uhlmann & Zacher GmbH, Waldbüttelbrunn (DE)

(72) Inventor: Karl-Heinz Schmück, Waldbüttelbrunn (DE)

(73) Assignee: UHLMANN & ZACHER GmbH, Waldbüttelbrunn (DE)

( * ) Notice: Subject to any disclaimer, the term of this patent is extended or adjusted under 35 U.S.C. 154(b) by 0 days.

(21) Appl. No.: 17/468,621

(22) Filed: Sep. 7, 2021

(65) Prior Publication Data

US 2021/0404217 A1 Dec. 30, 2021

Related U.S. Application Data

(63) Continuation of application No. PCT/EP2021/058338, filed on Mar. 30, 2021.

(30) Foreign Application Priority Data

Apr. 6, 2020 (EP) ..... 20168170

(51) Int. Cl.
*E05C 1/08* (2006.01)
*E05B 55/12* (2006.01)
*E05B 63/08* (2006.01)

(52) U.S. Cl.
CPC ..... *E05B 55/12* (2013.01); *E05B 63/08* (2013.01); *E05C 1/08* (2013.01); *Y10T 292/098* (2015.04); *Y10T 292/0977* (2015.04)

(58) Field of Classification Search
CPC ..... Y10T 292/0977; Y10T 292/098; Y10T 292/0982; Y10T 292/0983; Y10T 292/0984; Y10T 292/1031; E05B 55/12; E05B 63/08; E05C 1/08
USPC ... 70/150, 151 R, 151 A, 469, 470, 486, 487
See application file for complete search history.

(56) References Cited

U.S. PATENT DOCUMENTS 762,051 A * 6/1904 Hartman ..... E05B 55/00 70/143
979,948 A * 12/1910 Helms ..... E05B 55/00 70/150
1,062,302 A * 5/1913 Schoenfeld ..... E05B 21/00 70/355
1,272,417 A * 7/1918 Gee ..... E05B 55/00 70/150
1,876,081 A 9/1932 Schlage
2,291,878 A * 8/1942 Robertc ..... E05B 55/12 70/151 R (Continued)

FOREIGN PATENT DOCUMENTS

FR 1355736 A * 3/1964 ..... E05B 55/12
GB 647372 A 12/1950
GB 790414 A 2/1958

*Primary Examiner* — Carlos Lugo
(74) *Attorney, Agent, or Firm* — Quarles & Brady LLP; Yakov S. Sidorin

(57) ABSTRACT

A latch module for selectively engaging into a striking plate of door jamb, including at least a housing, a latch bolt, a guard bolt, and a stem for retracting the latch bolt is particularly versatile, safe and has low manufacturing costs, if the stem is movably supported relative to the latch bolt and if the stem has a block for entraining the latch bolt, if the stem reaches a first intermediate position while being moved from the stem's closed position towards the stem's open position.

7 Claims, 8 Drawing Sheets

(56) References Cited

U.S. PATENT DOCUMENTS

| | | | | | |
|---|---|---|---|---|---|
| 2,558,509 | A | * | 6/1951 | Cerf, Jr. | E05B 55/12 292/164 |
| 2,576,648 | A | | 11/1951 | Smith | |
| 2,768,014 | A | * | 10/1956 | Golden | E05B 55/12 292/169.13 |
| 3,144,266 | A | * | 8/1964 | Schmid | E05B 55/005 292/169.13 |
| 3,337,250 | A | * | 8/1967 | Russell | E05B 57/00 292/210 |
| 3,353,858 | A | * | 11/1967 | Neary | E05B 55/005 292/164 |
| 3,807,203 | A | * | 4/1974 | Larsen | E05B 55/06 70/149 |
| 3,876,236 | A | | 4/1975 | Best | |
| 4,318,558 | A | * | 3/1982 | Best | E05B 55/12 292/169.13 |
| 4,779,908 | A | * | 10/1988 | Foshee | E05B 55/12 292/163 |
| 4,848,118 | A | * | 7/1989 | Tesone | E05B 15/10 70/419 |
| 5,564,759 | A | * | 10/1996 | McNutt | E05B 1/0053 292/139 |
| 5,613,715 | A | * | 3/1997 | Kim | E05B 63/06 292/1.5 |
| 5,678,870 | A | | 10/1997 | Pelletier | |
| 6,899,362 | B1 | * | 5/2005 | Weinerman | E05B 13/105 292/336.3 |
| 9,637,958 | B2 | * | 5/2017 | Vanderick | E05C 3/122 |
| 2018/0187464 | A1 | | 7/2018 | Moon | |
| 2020/0056403 | A1 | | 2/2020 | Wong | |

* cited by examiner

C - C

LATCH MODULE

CROSS-REFERENCE TO RELATED APPLICATIONS

This application is a continuation of International Application No. PCT/EP2021/058338 filed on Mar. 30, 2021, which designates the United States and claims priority from European Application No. 20168170.7 filed on 6 Apr. 2020. The disclosure of each of the above-mentioned applications is incorporated herein by reference.

BACKGROUND

1. Field of the Invention

The invention relates to a latch module for a door. The latch module has a housing, a latch bolt, a guard bolt, and a stem.

2. Description of Related Art

Latch modules are usually inserted into a door jamb facing narrow side of a door. For example, US 2018/0187464 suggests a double latch lockset having a first latch module and a second latch module. The latch modules each have a housing with a first end and a second end. The first end of the housing, as well referred to as front end or as distal end of the housing, faces towards door jamb, assuming the door to be closed. The second end, i.e. the rear end or proximal end, is inserted into a mounting recess of the door leaf. One of the two latch modules has a dead bolt that can be extended into a whole of a striking plate. The other latch module has a latch bolt and a guard bolt. The latch bolt is coupled to a door lever and actuation of the door leaver retracts the latch bolt and a guard bolt from an extended position to a retracted position, thereby releasing an engagement of the latch bolt and the guard bolt with the striking plate. The guard bolt prevents the latch bolt from the so-called "credit card attacks"—that is, from being shifted into its retracted position by pressing a credit card or a screw driver or a knife into the gap between the door leaf and the striking plate and against an oblique surface of the latch bolt.

Another latch module is suggested in US 2020/0056403, similarly the latch module has a housing being inserted in a mortise of a door leaf. A latch bolt is configured to reciprocate between an extended and a retracted position.

GB 647372A, U.S. Pat. No. 2,576,648 A, GB 790414, U.S. Pat. Nos. 1,876,081 and 3,876,236A each disclose a latch module for releasably engaging into a striking plate of a door jamb. The latch modules have a housing, a latch bolt, a guard bolt, a blocking member and a stem. These type of latch modules have a door jamb facing end and door leaf facing end extending into a mortise of a door. The housing movably supports the latch bolt and the guard bolt. The stem has a block that in operation entrains an abutment of movably supported the latch bolt, if the stem reaches a first intermediate position while being moved from the stem's closed position towards the stem's open position.

SUMMARY

Embodiments of the invention solve a problem of providing a reliable and safe latch module for a door leaf that can be manufactured at reduced cost.

The latch module is preferably configured to be inserted into a mortise of a door jamb facing narrow side of a door leaf. An embodiment of the latch module (or a deadlatch assembly) includes a housing, a latch bolt, a guard bolt (which can also be referred to as a deadlatch button), and a stem. The latch module and thus as well the housing has a first end (referred to as a distal end) and a second end (or, a proximal end). Here, the first end may be configured to face towards the door jamb and the second end may be configured to extend into a mounting hole of a door, i.e. into the mortise of the door (for example, when the latch module is appropriately installed).

The housing may movably support the latch bolt and the guard bolt. For example, the housing may provide a linear bearing enabling a shift of the latch bolt and the guard bolt relative to the housing. Each of the latch bolt and the guard bolt may have a respective extended position and a respective retracted position. In the extended position the latch bolt and/or the guard bolt protrude over and outside of the distal end of the housing. In this extended position the latch bolt can engage into a recess of a striking plate. When the latch module is mounted, it inhibits or prevents the door leaf from swinging open. Retracting the latch bolt releases the engagement with the striking plate and the door leaf can be opened. Preferably, the latch bolt and/or the guard bolt are biased towards their respective extended positions. For example, a biasing spring (or any other elastic means) may be supported by the housing or at least relative to the housing and may be loaded by a movement of the latch bolt or the guard bolt, respectively, towards the corresponding retracted position.

The latch bolt may preferably have an inclined surface enabling to swing the door into its closed position without retracting the latch bolt manually by actuating the stem. This inclined surface, however, would allow for the above explained "credit-card attack". To avoid this, the guard bolt preferably senses if the door is open or closed. In the case when the door leaf is open, the guard bolt extends and preferably releases a blocking mechanism of the latch bolt, enabling the door leaf to be slammed into its closed position. However, if the door is closed, the guard bolt is preferably retracted and may ensure a blocking mechanism prevents the latch bolt from being pushed into its retracted position, while its retraction by operating the stem preferably remains possible. Hence, the guard bolt can as well be referred to as a "sensor bolt" or as "sensing plunger" configured for detecting if the door leaf is in its open position or in its closed position. For example, based on the result of the detection, an action of retracting the latch bolt by applying a force to the inclined surface may be blocked or permitted. In other words, the guard bolt may control the state of a blocking mechanism configured to releasably prevent the latch bolt from being retracted. The blocking mechanism may further be released by actuating the stem.

The stem has a longitudinal axis. This axis is herein used as a reference axis and may be referred to as the longitudinal axis. The stem may be movably supported relative to the housing and may have a closed position and an open position. Movable support may be provided, e.g. by a plain bearing restricting a movement for example to a particular movement along an axis at least essentially parallel to the longitudinal axis. The position of the stem may control the position of the latch bolt and of the guard bolt. For example, pulling the stem along the longitudinal axis away from the first side (i.e. in the proximal direction) retracts the latch bolt and optionally the guard bolt. The end position of the stem (in which the latch bolt and optionally the guard bolt are extended) is referred to as a closed position, whereas the position of the stem in which the latch bolt and the guard bolt are retracted is referred to as open position (i.e. closed position and open position of the stem also provide reference to the state of the corresponding door, which can be opened if the stem is in the open position and remains closed if the stem is in the closed position).

Alternatively or in addition to a translational movement, the stem may as well be (reversably) pivotally supported or rotationally supported. Without any limitation, however, is it assumed herein that the movement of the step is a translational movement.

Preferably, the stem is as well movably supported relative to the latch bolt. Further, the stem may have a block configured to entrain an abutment of the latch bolt. Thus, for example initially, the stem may be moved from its closed position (a closed position of the stem) in the direction of its open position (an open position of the stem) without entraining the latch bolt. Once the stem reaches a first intermediate position while being moved from the stem's closed position towards the stem's open position, the stem's block entrains the abutment of the latch and thereby couples the movement of the latch bolt to the movement of the stem. Shifting the stem from the first intermediate position towards the closed position of the stem releases the coupling. In the field of rotary couplings one would use the terms 'coupling is closed' or 'coupling is open'. In this sense, the stem and the latch bolt are coupled by a position selective coupling, being closed if the stem is between the first intermediate position and the open position and open if the stem is between the closed position and the first intermediate position. Thus, a position selective coupling defines a first path of the stem, wherein the stem travels without entraining the latch bolt. This first path may be used to control for example a blocking mechanism. For example, the first portion of the movement may be used to release a blocking mechanism maintaining the latch bolt in its extended position.

Preferably, the latch bolt has a first end and a second end. The latch bolt's first and second ends may face into the same directions as the first and second ends, respectively, of the latch module. Only to avoid ambiguities, the latch module's first end is configured to face towards the door jamb and the latch module's second end is configured to face in the opposite direction.

In a preferred example, the second end of the latch bolt has a recess being delimited by at least one bearing surface. For example, the bearing surface may be defined by at least one protrusion extending from the latch bolt. In another example, the bearing surface may be ring surface or a ring segment surface. The bearing surface is preferably at least essentially parallel to the stem's longitudinal axis. The bearing surface may thereby be configured to support the stem perpendicular to the stem's longitudinal axis while enabling a movement of the stem relative to the latch bolt's bearing surface at least essentially parallel to the longitudinal axis. In other words, the stem and the latch bolt may be connected via a linear bearing, wherein the bearing may be integrated in the stem and/or the latch module. Each of these measures is cheap to manufacture and contribute to a reliable and failsafe operation of the latch module.

A first end of the stem may extend into and/or through the recess, (the term 'into the recess' when used includes the situation of 'through the recess'). The first end of the stem may further be configured to enable a translation of the stem along the stem's longitudinal axis and relative to bearing surface. The translation may be limited in axial direction by the stem's block and the latch bolt's abutment. Each of these measures is cheap to implement in manufacture and contributes to a reliable and failsafe operation of the latch module.

Particularly preferred is a configuration in which the guard bolt has a an abutment facing the latch bolt (which may be referred to as a latch bolt facing abutment) and the latch bolt has a block that faces the guard bolt (which may be referred to as a guard bolt facing block), and in which the latch bolt's block is positioned to contact the guard bolt's abutment when the latch module is entrained by the stem towards the latch module's retracted position. The latch bolt facing abutment of the guard bolt may thus have a surface facing at least essentially in the distal direction. Similarly, the guard bolt facing block of the latch bolt may have a surface facing at least essentially in the proximal direction. The surface of the guard bolt's latch bolt facing abutment and the surface of the latch bolt's guard bolt facing block may each have at least one point being spaced relative to the longitudinal axis at the same distance than the respective point of the opposed surface. In other words, the optional guard bolt's a latch bolt facing abutment protrudes into the traveling path of the latch bolt's guard bolt facing block. Thereby, if the latch bolt is retracted by a corresponding movement of the stem, it automatically entrains the guards bolt. These measures, as well, each contribute to a reliable latch module and reduced manufacturing costs.

For example, the optional blocking mechanism may include a blocking member. The optional blocking member, when present, may be movably supported to enable a movement of the blocking member from a blocking position to a released position and back to the blocking position. The movement may be enabled, e.g., by a hinge mechanism and/or another type of bearing. Preferably, the blocking member may be configured to block a retraction of the latch bolt, when in the blocking member's blocking position and to release blocking the retraction of the guard bolt, when the blocking member is in the released position. Thereby, manipulation of the closed latch is successfully prevented at low manufacturing costs.

Preferably, the guard bolt maintains the blocking member in the blocking member's released position, if the guard bolt is in the guard bolt's extended position. For example, a portion of the guard bolt may be positioned at the blocking members blocking position, if the guard bolt is in the guard bolt's extended position. Thus, if an open door is slammed into the door jamb, the latch bolt can retract and the door closes. "Slamming" herein means pivoting the door leaf until it reaches a final position in the door jamb without actuating the door lever. Thus, when slamming a door, the stem is not manually pulled into its open position by actuating of a door lever.

As explained above, the latch bolt may entrain the guard bolt. Alternatively, other measures for retracting the guard bolt may be taken when the latch bolt retracts. For example, the guard bolt may have an oblique or inclined surface like the latch bolt.

In the case when the guard bolt is in its retracted position, the guard bolt, preferably, does not inhibit the blocking member from being shifted, e.g. by a spring, into the blocking position, thereby preventing the latch bolt from being retracted by use of a credit card being inserted into a gap between the door leaf and the door jamb. Now, assuming the case in which the door is closed (and the stem is not maintained in its open position), the guard bolt may be maintained retracted, e.g. by a door jamb and/or striking plate, whereas the latch is extended. Thus, opening the latch bolt by a manipulation via the gap between the door jamb and the door leaf is impossible, because the blocking member has been shifted into its blocking position, e.g. by a spring. Generalizing, one may say that in a preferred example, the guard bolt is preferably configured to maintaining the blocking member in the blocking member's blocking position, if the guard bolt is in the guard bolt's retracted position. Further, the guard bolt and the blocking member are preferably coupled, be it directly or indirectly, to shift the blocking member into its blocking position when the guard bolt is retracted and/or to shift the blocking member into its released position when guard bolt moves into extended position.

For example, the guard bolt when shifted into its retracted position may free a space of the blocking member in the blocking member's blocking position. In slightly different words, in the retracted position the guard bolt may provide the space for the blocking member to be shifted into the blocking member's blocking position. However, in its extended position, the guard bolt may occupy at least a portion of the space the blocking member occupies when entering the blocking position, thereby inhibiting the blocking member to be shifted, e.g. by a spring, into the blocking position. Shifting the guard bolt from its extended position into its retracted position thereby opens a space into which the blocking member maybe shifted, e.g. by a spring until it reaches the blocking member's blocking position.

In a preferred example, the stem may include a releasing member. The releasing member may be positioned to entrain the blocking member from the blocking member's blocking position into the blocking member's released position, when the stem is moved from its closed position into a second intermediate position. In other words, the stem may be (preferably releasably) coupled via the releasing member, e.g. by a transmission, to the blocking member. The releasing member may include, e.g., a protrusion interacting with an abutment of the blocking member while the stem is shifted from the second intermediate position towards the stem's open position. The coupling between the stem and the blocking member provides a safe and reliable mechanism for releasing the blocking member and thus the latch bolt.

Preferably, the second intermediate position is in between of the closed position of the stem and the first intermediate position of the stem. Particularly preferred is a configuration in which the second intermediate position of the stem is closer to the closed position of the stem than to the first intermediate position. These measures provide a very fail-safe mechanism, while reducing 'un-used' traveling path of the stem, which immediately translates in less material consumption when manufacturing the latch module.

A preferred example blocking member may include at least a first leg and a second leg. A front-end portion of the first leg may be connected, e.g. by a front hinge, to the latch bolt. The front hinge has an axis around which the front leg may pivot, i.e. the front hinge defines a front hinge axis. A rear-end portion of the second leg may be connected by a rear hinge at least indirectly to the housing, wherein the rear hinge defines a rear hinge axis. The rear hinge axis and the front hinge axis are preferably at least essentially parallel, i.e. parallel within a possible angular deviation of ±15°, more preferrably within ±10°, ±5° or even less. In this sense the front hinge axis and the rear hinge axis are in a single plane. A rear-end portion of the first leg and a front-end portion of the second may be connected by a middle hinge. Accordingly, the first and second legs may pivot relative to each other, thereby enabling a movement of the latch bolt towards its retracted position and from the retracted position back into the extended position. The middle hinge defines a middle hinge axis, which is the axis of the pivotal movement of the front and rear leg relative to each other. This middle hinge axis may be on a first side of the plane if the blocking member is in the blocking position and on the opposite side of the plane, if the blocking member has been shifted to the open position. Preferably, the front leg and the rear leg define an angle $\alpha$, wherein the vertex is on the middle hinge axis. In the blocking position the angle $\alpha$ is preferably smaller than 180°, e.g. $\alpha_{min} \leq \alpha \leq 180°$, wherein $\alpha_{min}$ is a constant. In the released position the angle $\alpha$ may be greater than 180 ($\alpha > 180°$. $\alpha_{min}$ is preferably between 90° and 180°, to be more precise, $\alpha_{min} \in [90°, 180°]$. The so obtained blocking member can be assembled with in a very short amount of time and reliably inhibits the guard bolt from unintentional retraction. Preferably, the blocking member may be biased towards the blocking position, e.g. by a spring or any other elastic biasing member.

The angle $\alpha_{min}$ may be defined by a block of the front leg abutting the rear leg at $\alpha = \alpha_{min}$. Alternatively, $\alpha_{min}$ may be defined by a block of the rear leg abutting the front leg at $\alpha = \alpha_{min}$. In another example, at least one of the front leg or the rear leg may abut the housing at $\alpha = \alpha_{min}$. These alternatives can as well be combined, i.e. they are independent options.

As already apparent from the above, herein the term "spring" is used as a pars pro toto for an "elastic biasing member" or more generally for a "reversibly loadable potential energy storage".

Here, the term "at least essentially" is used in reference to a given direction to indicate that that such given direction is preferred, but that at the same time deviations from the given direction may occur. In this sense the terms extending, pointing or facing at least essentially in a given direction can be defined as extending, pointing or facing, respectively, in such given direction within the limits of a spatial deviation of ±15°, more preferably within ±10°, ±5°, or less.

BRIEF DESCRIPTION OF THE DRAWINGS

In the following, the invention will be described by way of example, without limitation of the general inventive concept, on examples of embodiment and with reference to the drawings.

Figure 1:
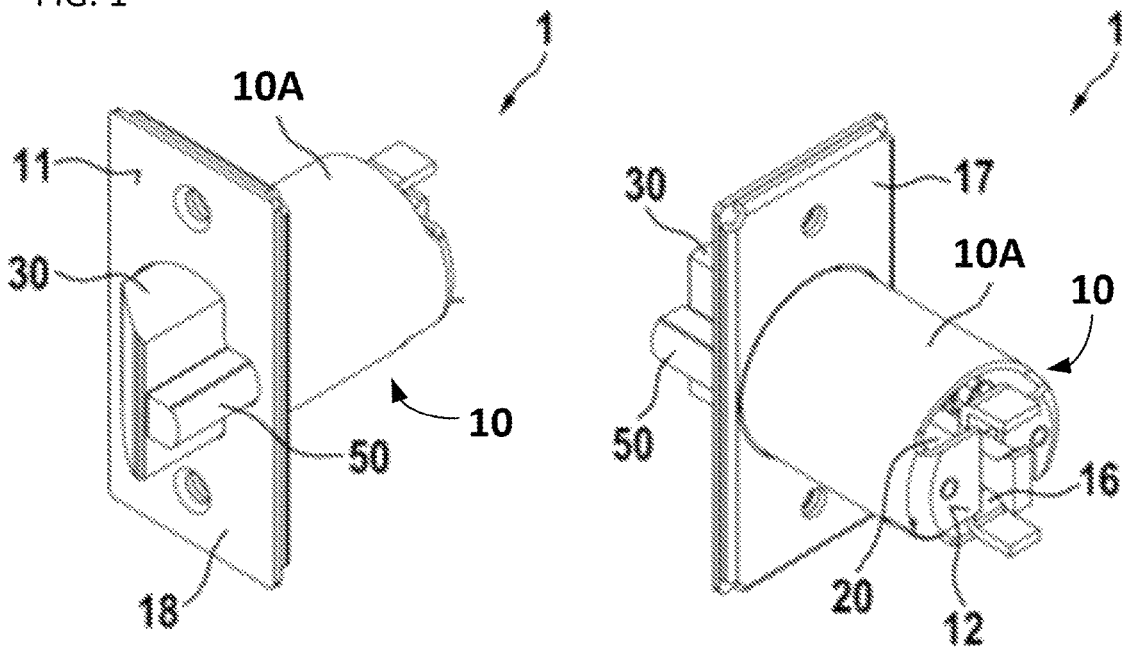
FIG. 1 shows two perspective views of a latch module.
Figure 2:
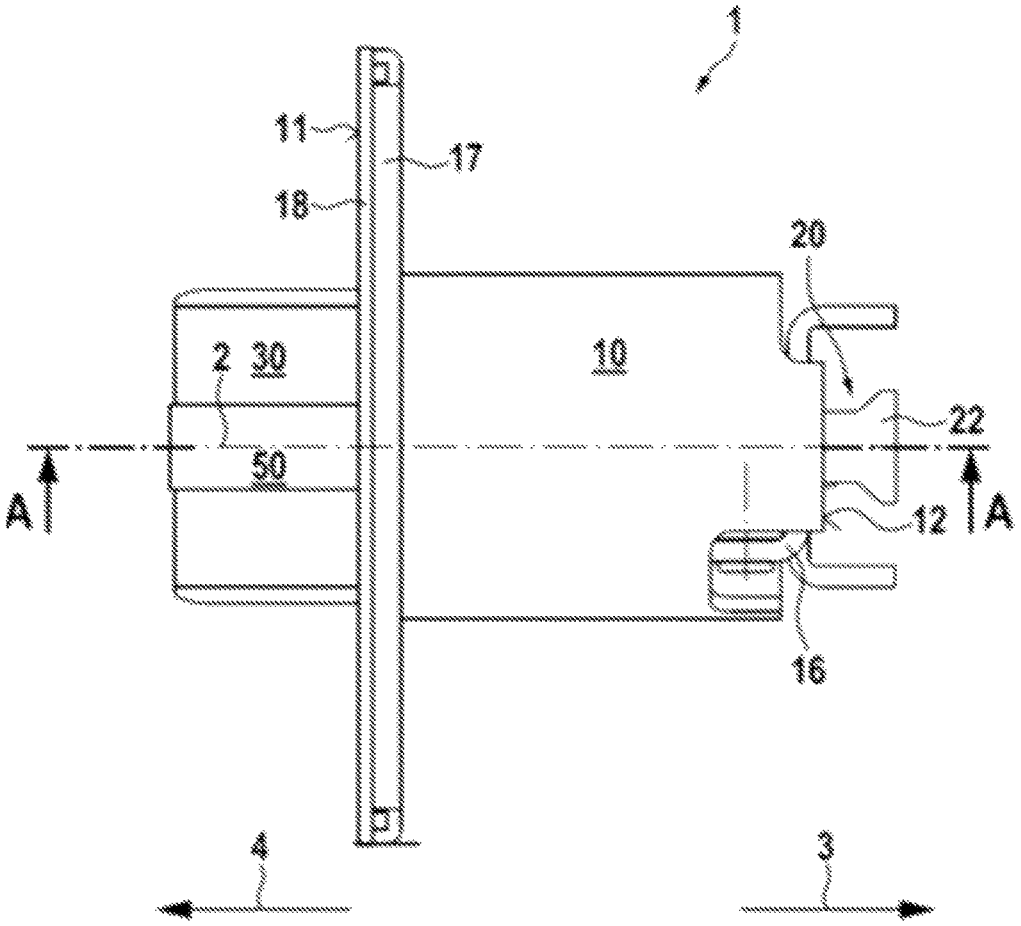
FIG. 2 shows a side view of the latch module.

Generally, the drawings are not to scale. Like elements and components are referred to by like labels and numerals. For the simplicity of illustrations, not all elements and components depicted and labeled in one drawing are necessarily labels in another drawing even if these elements and components appear in such other drawing.

While various modifications and alternative forms, of implementation of the idea of the invention are within the scope of the invention, specific embodiments thereof are shown by way of example in the drawings and are described below in detail. It should be understood, however, that the drawings and related detailed description are not intended to limit the implementation of the idea of the invention to the particular form disclosed in this application, but on the contrary, the intention is to cover all modifications, equivalents and alternatives falling within the spirit and scope of the present invention as defined by the appended claims.

DETAILED DESCRIPTION

The latch module (a deadlatch assembly) as shown in FIGS. 1, 2, 3, 4A, 4B, 5A, 5B, and 6 has a housing 10 with a door-jamb-facing surface 11 and a door-leaf-facing surface 12. The door-jamb-facing surface 11 defines a first end of the housing 10 (a so called distal end of the housing. At the opposite side of the distal end of the housing 10 is a door-leaf-facing surface 12, defining a second end or the so-called proximal end of the housing 10 (see, for example, FIGS. 1 and 2). As can be seen for example in FIG. 6, the housing 10 may include a sleeve portion 10A, a stem guide 16, a rear plate 17 and a front plate 18.

Figure 4A:
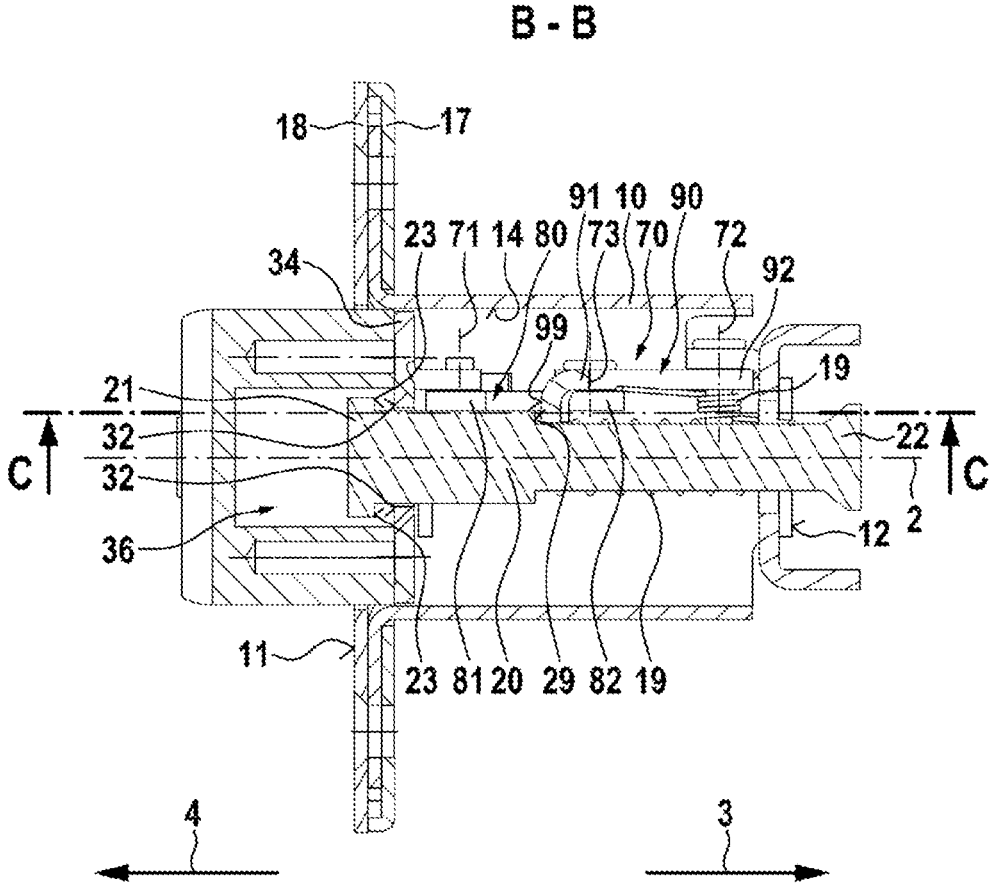
FIGS. 4A and 4B show a sectional view of the latch module along the plane B-B indicated in FIG. 3, however with different positions of a blocking member.
Figure 4B:
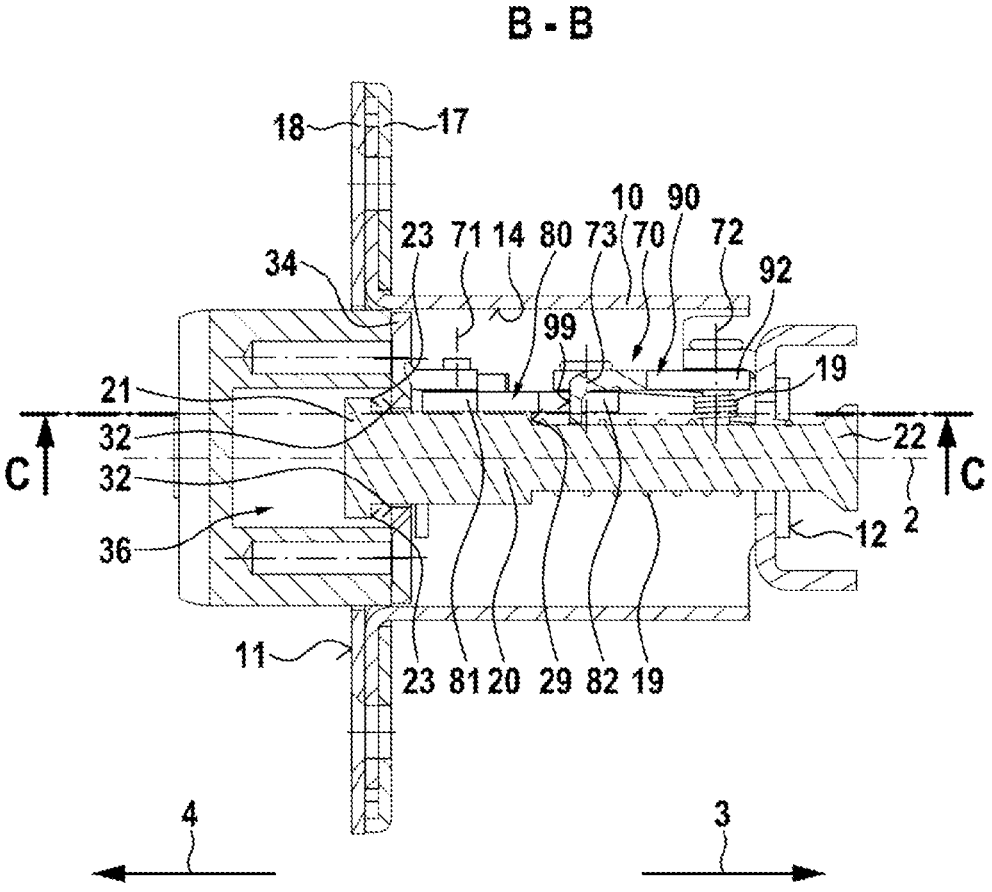
Figure 5A:
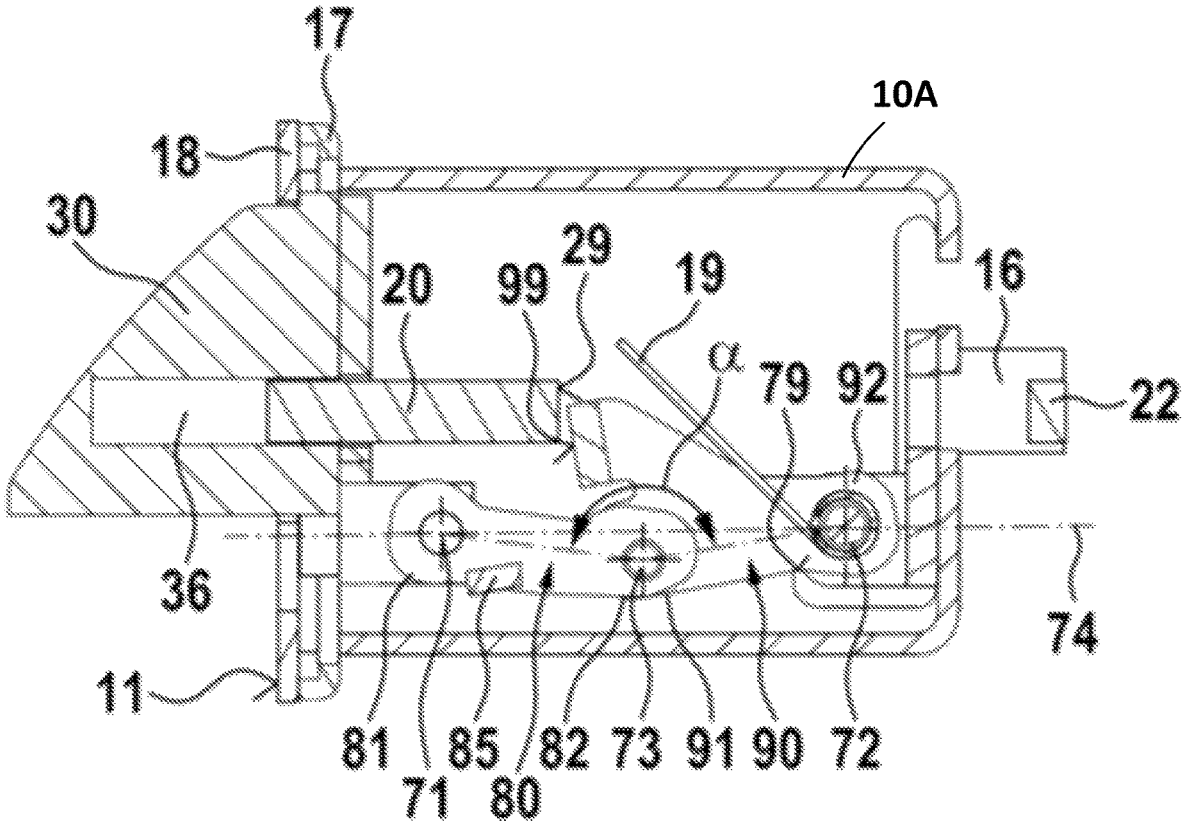
FIGS. 5A and 5B show a sectional view of the latch module along the plane C-C indicated in FIGS. 4A and 4B, respectively.

Generally, the housing 10 movably supports a latch bolt 30 and guard bolt 50. A stem 20 (shown in FIG. 2) extends to the proximal side out of the housing 10 and is structured to be connected to a transmission configured to convert a pivotal movement of a door handle into a translation, thereby pulling the stem 20 in the proximal direction 3 (see FIGS. 1 and 2). As will be explained in more detail below, a movement of the stem 20 (from its closed position as shown in FIGS. 2, 3, 4A, 4B) in the proximal direction (that is indicated by an arrow 3) first releases the blocking mechanism and subsequently entrains the latch bolt 30 into a retracted position. The latch bolt 30 entrains the guard bolt 50 until both reach their respective retracted positions. Now, the door leaf can be swung and thus opened open. In the case when the door has been opened and the door handle (or any other kind of actuation means) is released, the latch bolt 30 and the guard bolt 50 are advanced by elastic biasing means 19 (shown, for example, in FIG. 19, and referred to as aspring 19, for short) into their respective extended position. This extended position of the latch bolt 30 is illustrated in FIGS. 1, 2, 3, 4A, 4B, 5A, and 5B. FIGS. 1 to 3, 4B and 5B show the latch module with the guard bolt 50 in its extended position as well. FIG. 4A and FIG. 5A show a blocking member or mechanism 70 in a blocking position, which is taken or assumed by the blocking member 70 if the guard bolt 50 is retracted while the latch bolt 30 is extended. As will be apparent from the discussion below, in the extended position the guard bolt 50 maintains a blocking mechanism 70 released and the latch bolt 30 can retract if the door is slammed into its closed position.

In the case when the door is closed, the corresponding striking plate or any other portion of the door jamb maintains the guard bolt 50 in its retracted position. The blocking member 70 can thus engage and block a retraction of the latch bolt, until the blocking member 70 is released by pulling the stem in the proximal direction 3.

Figure 3:
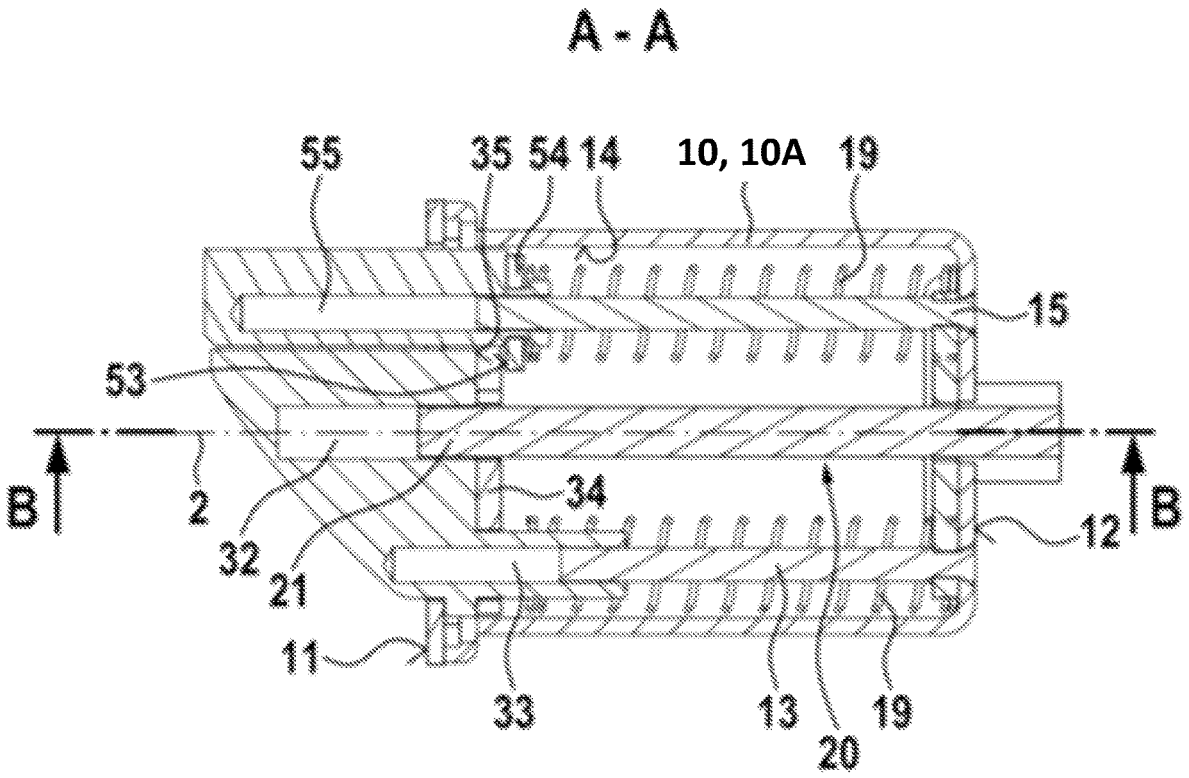
FIG. 3 shows a sectional view of the latch module along the plane A-A indicated in FIG. 2.

As can be seen in FIG. 3, the housing 10 may have or enclose at least one bearing rod (shown here as bearing rods 13, 15) essentially parallel to the longitudinal axis 2. The bearing rods 13, 15 of the example of FIG. 3 may each have a cylindrical peripheral surface. For the commonly-recognized and accepted definition of a cylinder and a cylindrical surface see Bronstein, Semendyayev, Musiol & Muehlig Handbook of Mathematics, Springer Berlin Heidelberg, 2007, 5th ed.; Chapter 3.3.4. Cylinders may have circular and non-circular direction curves and thus corresponding cross sections; for the purposes of this disclosure the surfaces with a circular cylindrical volume are preferred.

At least a portion of such peripheral surface may be a plain bearing surface configured to enable a translation of the latch bolt 30 and the guard bolt 50, respectively, essentially parallel to the longitudinal axis 2 along the respective bearing rod of rods 13, 15. Accordingly, the latch bolt 30 and the guard bolt 50 may each have at least one recess (shown in FIG. 3 as respective recesses 33 and 55) having an inner surface, providing a complementary plain bearing surface. Further, an inner surface 14 of the housing 10 may provide a further plain bearing surface movably supporting the latch bolt 30 and the guard bolt 50. The latch bolt 30 and the guard bolt 50 may slide along the inner surface 14 of the housing 10 with at least a portion of their respective peripheral surfaces.

The guard bolt 50 may have an abutment 53 that faces the latch bolt 30. The abutment 53 of the guard bolt 50 may be integrally formed, e.g., by a protrusion of the guard bolt 50. Alternatively, as depicted, the abutment 53 of the guard bolt 50 may be provided by an abutment plate 54. Like in the depicted example, the abutment plate 54 may extend orthogonally to the longitudinal axis 2 into the path of the latch bolt 30. Thus, when retracting the latch bolt 30, the abutment 35 of the latch bolt may contact a block 35 (that faces the guard bolt 50) of the latch bolt 30, thereby entraining the guard bolt 50 towards the retracted position. In other words, if the latch bolt 30 is in its retracted position, the guard bolt 50 is a corresponding retracted position as well. The guard bolt 50, in contrast may be shifted (and/or maintained) into (in) its retracted position while the latch bolt 30 remains extended or is in the process of being extended.

As was already mentioned initially, the stem 20 is preferably movably supported relative to the housing 10. A rear portion 22 of the stem 20 may be configured to be coupled to a transmission. As can be seen in FIGS. 4A and 4B, the stem 20 may be movably supported relative to the latch bolt 30, as well. For example, as depicted, a front-end portion 21 (also referred to as distal portion 21) of the stem 20 may engage, e.g. via a through hole in an optional rear plate 34 of the latch bolt 30 into a(nother) recess 36 of the latch bolt 30. For simplicity, such through hole may be considered as a part of another recess 36. At least a portion of the surface delimiting the trough hole may be a plain bearing surface enabling a translation of the stem 20 relative to the latch bolt 30 essentially parallel to the longitudinal axis 2. This movement of the stem 20 relative to the latch bolt 30 may be limited in the proximal direction 3. For example, as can be seen in FIGS. 4A and 4B, the stem 20 may have a block 23 configured to entrain an abutment 32 of the latch bolt 30. The position of the stem 20, when the block 23 contacts the abutment 32, is referred to as a first intermediate position. The act of retracting the stem 20 from the first intermediate position towards its open position retracts the latch bolt 30.

An embodiment 1 of the latch module may further include a blocking member 70. The blocking member 70 can be seen in FIGS. 4A, 4B, 5A and FIG. 5B: The blocking member 70 may include a first leg 80 and second leg 90. The first leg 80 (also referred to as the front leg 80) has a front-end portion 81 and a rear-end portion 82. Similarly, the second leg 90 (also referred to as the rear leg 90) has a front-end portion 91 and a rear-end portion 92. The front-end portion 81 of the first leg 80 may be pivotably hinged to the latch bolt 30 by a front hinge. The front hinge has a front hinge axis 71. The first leg 80 may thus pivot relative to the front hinge axis 71.

The rear-end portion 82 of the first leg 80 may be connected by a middle hinge (indicated by a middle hinge axis 73) to the front-end portion 91 of the second leg 90, thereby enabling a pivotal movement of the first and second legs 80, 90 relative to each other around the middle hinge axis 73. The rear-end portion 92 of the second leg 90 may be connected by a rear hinge, as indicated by a rear hinge axis 72, relative to the housing 10 or any other structure being firmly attached to a door leaf (or door jamb) when the latch module 1 is mounted to the door leaf (or door jamb).

Figure 5B:
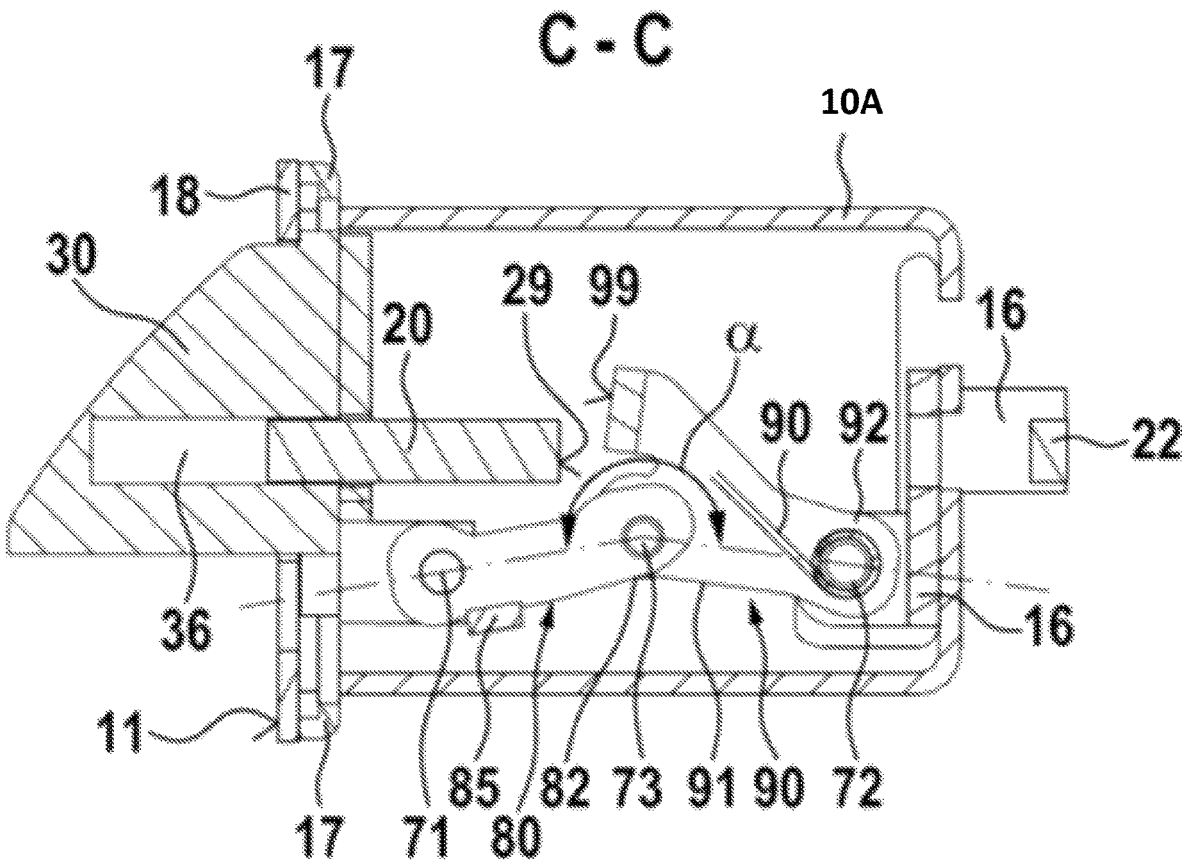
Figure 6:
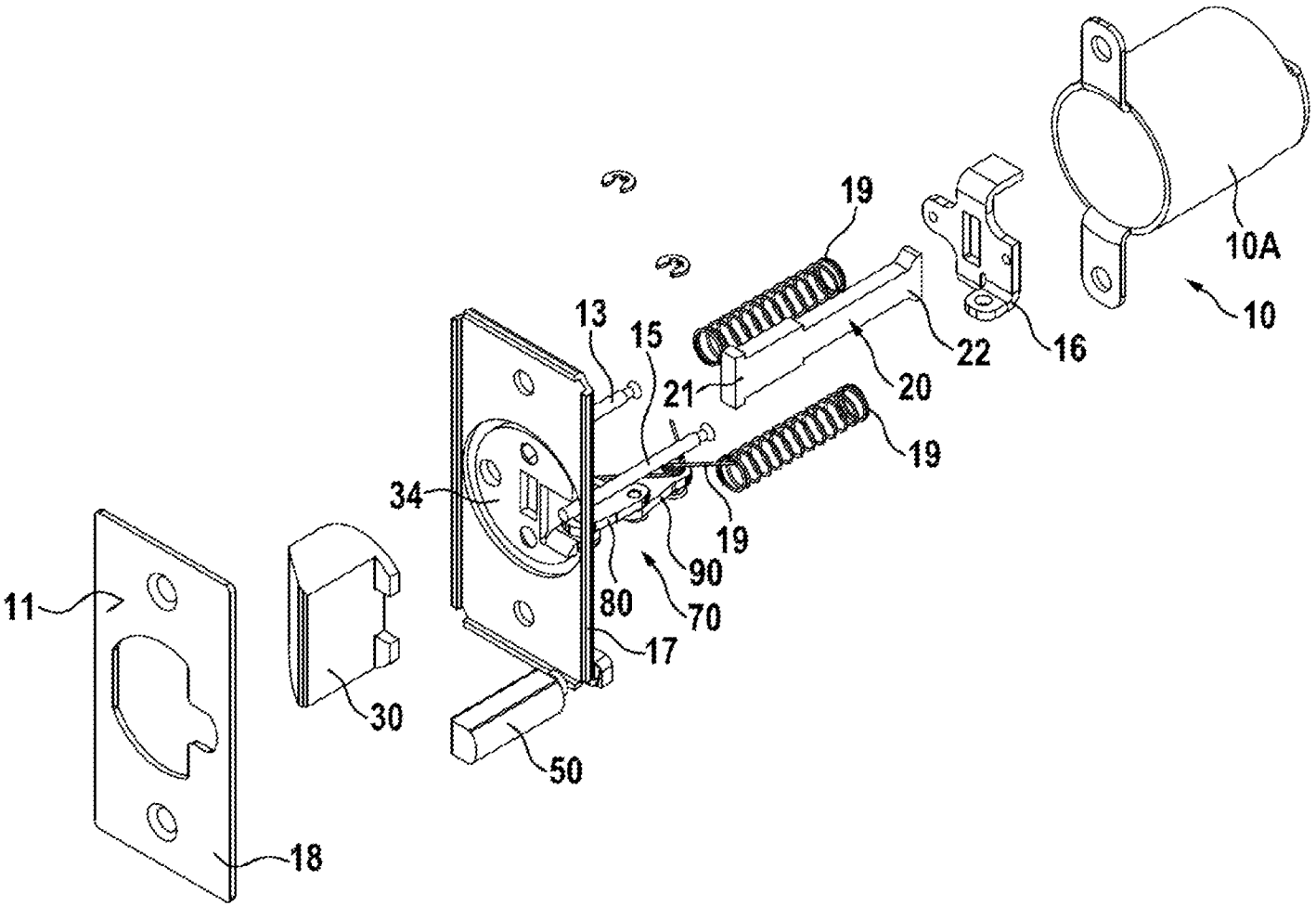
FIG. 6 shows an exploded view of the latch module.
Figure 7:
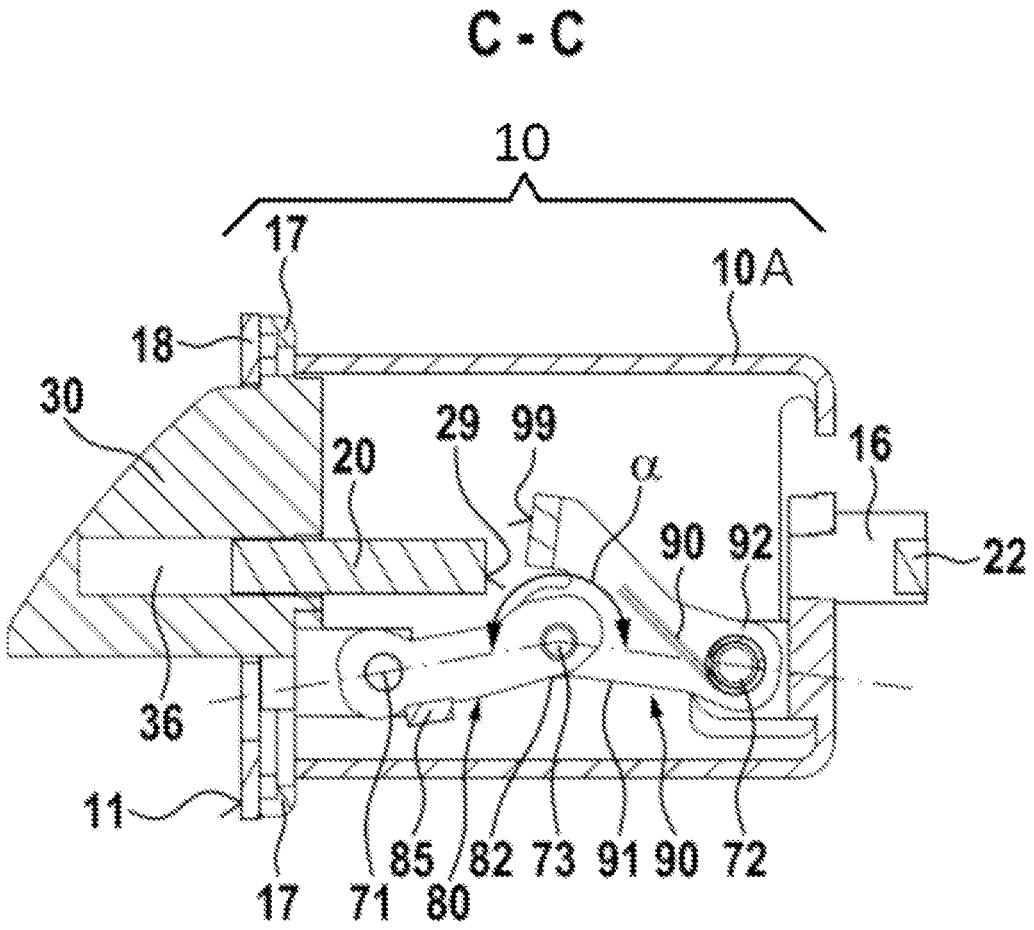
FIG. 7 illustrates a sectional view of an alternative implementation of the latch module.

As can be seen, the three axes 71, 72 and 73 are preferably at least essentially parallel to each other and therefore can define a plane 74 that includes the front and rear hinge axes 71 and 72 (see FIGS. 5A, 5B). The front and rear legs 80, 90 may be inclined with respect to one another at an angle $\alpha$. This optional angle $\alpha$ can take different values, depending on the relative position of the first and second legs 80, 90 relative to each other, however it has a minimum value as shown in FIG. 4A and FIG. 5A. This minimum value may be defined by a block 79 being attached to the housing 10 or being integrally formed by the housing 10. In the depicted example, the block 79 is provided by the stem guide 16 of the housing 10. It is noted that the block 79 may be provided by any other part, provided the block 79 limits the movement of the second leg 90. Alternatively or in addition, the block 79 may be positioned to block the movement of the first leg 80, e.g. by abutting the first leg 80 in the case when the blocking member is in its blocking position. Regardless of the position of the block 79, it preferably delimits a movement of the hinged legs 80, 90 in a direction perpendicular to the plane 74 to thereby define a minimum angle $\alpha_{min}$. In FIGS. 4A and 5A the positions of the first and second legs 80, 90 correspond to such minimum angle $\alpha_{min}$, i.e. $\alpha=\alpha_{min}$ When a force is applied in the proximal direction 3 to the extended portion of the latch bolt 30, a movement of the latch bolt 30 is blocked by the blocking member 70, as the first and second legs 80, 90 are blocked from pivoting in a direction which would reduce the angle $\alpha$ below $\alpha_{min}$. It is recalled that in FIGS. 4A and 5A the guard bolt 50 is in its retracted position (in FIG. 4A the guard bolt is hidden from view by the stem 20, and in FIG. 5A the guard bolt 50 is below the section plane C-C). However, when pulling the stem 20 towards its open position (i.e. in the proximal direction 3) a releasing member 29 of the stem may contact an abutment 99 of the blocking member 70. The position of the stem 20, when this contacting takes place is referred to as a second intermediate position. The act of shifting the stem 20 from the second intermediate position to the first intermediate position, shifts the middle axis 73 of the blocking member 70 on the opposite side of the plane 74 (i.e. $\alpha>180°$). The result is similar to the situation depicted in FIGS. 4B and 5B, however in these two Figures the blocking member 70 is maintained in its released position by the guard bolt 50. In FIGS. 4B and 5B the stem is in its closed position. The same situation is depicted in FIG. 7 as well: FIG. 7 distinguishes from FIG. 5B only in that the optional rear plate 34 of the latch bolt has been omitted, and that the rear-end portion 92 of the second leg 90 is shown directly connected by a rear hinge, as indicated by a rear hinge axis 72, to the housing 10.

By shifting the stem 20 from the second intermediate position into the first intermediate position, the blocking member 70 is released. At the first intermediate position, the stem's block 23 contacts the latch module's abutment 32 and thus entrains the latch bolt 30 in the proximal direction, thereby enabling a user to open the door by pulling (e.g., via an optional transmission) the proximal end 22 of the stem 20. After the door leaf has been swung to open, the pulling force may be released. The latch bolt 30 and the guide bolt 50 are shifted by the elastic members 19 (springs, for example) into their corresponding extended positions. The blocking member 70 is as well biased by an elastic biasing member 19 (spring 19, for short) towards the blocking position of the blocking member 70, however the extended guard bolt 50 prevents the blocking member 70 from entering the blocking position. This situation is depicted in FIG. 4B and FIG. 5B. For example, a protrusion 85 of the first leg 80 may interfere with a rear portion of the extended guard bolt 50. There are multiple possibilities, a first of which has already been indicated above, namely the protrusion 85 may abut the guard bolt 50, when the guard bolt 50 is in its extended position. In this example, the protrusion 85 may abut the abutment plate 54 when the guard bolt 50 is extended. Retracting the guard bolt 50 shifts the abutment plate 54 into another position and enables the blocking member 70 to enter its blocking position. Alternatively or in addition, the guard bolt 50, when being retracted, may shift the blocking member 70 into the released position of the blocking member 70. In both cases, the latch bolt 30 (entraining the guard bolt 50), may become temporarily retracted if the door is slammed into the door jamb and the door closes: The oblique surface of the latch bolt 30 hitting the door jamb's striking plate provides a pushing force in the proximal direction 3. Because the guard bolt 50 is extended, the blocking mechanism 40 is released (or becomes released when the guard bolt 50 is entrained by the block 35, of the latch bolt, contacting the guard bolt's abutment 53). In other words, the latch bolt 50 may retract until the door leaf reaches its closed position and the spring 19 extends the latch bolt 30 to engage into the striking plate. The striking plate at the same time inhibits the guard bolt 50 from extending and, as a consequence, the blocking member's biasing spring 19 shifts the blocking member into its blocking position. Now, the latch bolt 30 is blocked in its extended position and retracting the latch bolt 30 by a credit card is reliably prevented.

It will be appreciated to those skilled in the art having the benefit of this disclosure that this invention is believed to provide a latch module. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

For the purposes of this disclosure and the appended claims, the use of the terms "substantially", "approximately", "about", "essentially" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "to great or significant extent", "largely but not necessarily wholly the same" such as to reasonably denote language of approximation and describe the specified characteristic or descriptor so that its scope would be understood by a person of ordinary skill in the art. In one specific case, the terms "approximately", "substantially", "essentially" and "about", when used in reference to a numerical value, may represent a range of plus or minus 20% with respect to the specified value, more preferably plus or minus 10%, even more preferably plus or minus 5%, most preferably plus or minus 2% with respect to the specified value. As a non-limiting example, two values being "substantially equal" to one another may imply that the difference between the two values may be within the range of +/−20% of the value itself, preferably within the +/−10% range of the value itself, more preferably within the range of +/−5% of the value itself, and even more preferably within the range of +/−2% or less of the value itself.

LIST OF REFERENCE NUMERALS

1 latch module/deadlatch assembly
2 longitudinal axis
3 proximal direction
4 distal direction
10 housing
10A sleeve portion of the housing
11 first side
12 second side
13 bearing rod
14 inner surface (plain bearing surface)
15 bearing rod
16 stem guide of the housing
17 rear plate of the housing
18 front plate of the housing
19 elastic biasing means (e.g. spring)
20 stem
21 front-end portion (distal portion) of stem 20
22 rear-end portion (proximal portion) of stem 20
23 block
27 releasing member
30 latch bolt
32 abutment
33 recess
34 rear plate of the latch bolt
35 guard bolt facing block
36 recess
50 guard bolt/deadlatch button
53 latch bolt facing abutment
54 abutment plate
55 recess
70 blocking mechanism
71 front hinge axis
72 rear hinge axis
73 middle hinge axis
74 plane
80 first leg
81 front-end portion of the first leg
82 rear-end portion of the first leg
90 second leg
91 front-end portion of the second leg
92 rear-end portion of the second leg

The invention claimed is:

1. A latch module configured to selectively engage a striking plate of a door jamb and comprising at least a housing, a latch bolt, a guard bolt, a blocking member, and a stem, wherein the latch module has a first end and a second end, wherein the first end is configured to face towards the door jamb and the second end is configured to extend into a mortise of a door, the housing movably supports the latch bolt and the guard bolt, the latch bolt has a latch bolt extended position and a latch bolt retracted position, and the guard bolt has a guard bolt extended position and a guard bolt retracted position, and each of the latch bolt and the guard bolt is being biased into a respective corresponding extended position, the stem has a stem longitudinal axis and is movably supported relative to the housing, the stem having a stem closed position and a stem open position, the stem is movably supported relative to the latch bolt, the stem has a stem block configured to entrain an abutment of the latch bolt when the stem reaches a first intermediate position while being moved from the stem closed position towards the stem open position, the blocking member is movably supported between a blocking position and a released position, and wherein the blocking member is configured to block a retraction of the latch bolt, when the blocking member is in the blocking position and to release said block of the retraction of the latch bolt, when the blocking member is in the released position, the guard bolt is configured to maintain the blocking member in the released position, when the guard bolt is in the guard bolt extended position, wherein (i) the blocking member includes a first leg and a second leg, (ii) a front-end portion of the first leg is connected by a front hinge to the latch bolt, wherein the front hinge defines a front hinge axis, (iii) a rear end of the second leg is connected by a rear hinge at least indirectly to the housing, wherein the rear hinge defines a rear hinge axis, (iv) the front hinge axis and the rear hinge axis define a plane, (v) a rear-end portion of the first leg and a front-end portion of the second leg are connected by a middle hinge, wherein the middle hinge defines a middle-hinge axis, wherein the middle-hinge axis is on a first side of the plane when the blocking member is in the blocking position and on an opposite side of the plane when the blocking member is shifted to the released position, (vi) the front leg and the rear leg define an angle $\alpha$ therebetween, wherein when the blocking member is in the blocking position $\alpha_{min} \leq \alpha \leq 180°$, and when the blocking member is in the released position $\alpha > 180°$, wherein $\alpha_{min} \in [90°, 180°[, \alpha_{min} = \text{const}$.

2. The latch module of claim 1, wherein:

(i) the latch bolt has a first end and a second end, (ii) the second end of the latch bolt has a recess that is delimited at least in part by at least one bearing surface, (iii) a first end of the stem extends into the recess, and (iv) the bearing surface is configured to support the stem substantially perpendicularly, within ±15°, to the stem longitudinal axis and further configured to enable a translation of the stem along the stem longitudinal axis and relative to the bearing surface delimiting at least a portion of the recess, said translation being delimited by the stem block and the abutment of the latch bolt.

3. The latch module of claim 1, wherein:

the guard bolt has a guard bolt abutment that faces the latch bolt and the latch bolt has a latch bolt block that faces the guard bolt and that the latch bolt block is configured to contact the guard bolt abutment when the latch module is entrained by the stem towards the latch bolt retracted position.

4. The latch module of claim 1, wherein:

the guard bolt in the guard bolt extended position maintains the blocking member in the released position, and in that the guard bolt in the guard bolt retracted position provides space for the blocking member to be shifted into the blocking position.

5. The latch module of claim 1, wherein:

(i) the stem includes a releasing member, (ii) the releasing member is positioned to entrain the blocking member from the blocking position into the released position when the stem is moved from the stem closed position into a second intermediate position, while the guard bolt is in the guard bolt retracted position.

6. The latch module of claim 5, wherein the second intermediate position is in between the stem closed position and the first intermediate position.

7. The latch module of claim 1, wherein:

$\alpha_{min}$ is defined by a block of the front leg abutting the rear leg at $\alpha=\alpha_{min}$, and/or $\alpha_{min}$ is defined by a block of the rear leg abutting the front leg at $\alpha=\alpha_{min}$, and/or at least one of the front leg and the rear leg abuts the housing or the guard bolt in the guard bolt retracted position at $\alpha=\alpha_{min}$.

* * * * *